US009885200B2

(12) United States Patent
Hagemeyer et al.

(10) Patent No.: US 9,885,200 B2
(45) Date of Patent: Feb. 6, 2018

(54) HANDLE-ACTUATED SLIDING DOOR LOCK ACTUATION ASSEMBLIES

(71) Applicant: Amesbury Group, Inc., Amesbury, MA (US)

(72) Inventors: Bruce Hagemeyer, Pella, IA (US); Tracy Lammers, Sioux Falls, SD (US); Dan Raap, Hartford, SD (US); Gary E. Tagtow, Sioux Falls, SD (US); Tim Eggebraaten, Sioux Falls, SD (US)

(73) Assignee: AMESBURY GROUP, INC., Amesbury, MA (US)

( * ) Notice: Subject to any disclaimer, the term of this patent is extended or adjusted under 35 U.S.C. 154(b) by 814 days.

(21) Appl. No.: 13/920,301

(22) Filed: Jun. 18, 2013

(65) Prior Publication Data

US 2013/0334829 A1 Dec. 19, 2013

Related U.S. Application Data

(60) Provisional application No. 61/661,081, filed on Jun. 18, 2012.

(51) Int. Cl.

| | |
|---|---|
| ***E05B 3/00*** | (2006.01) |
| ***E05B 7/00*** | (2006.01) |
| ***E05B 1/00*** | (2006.01) |
| *E05B 65/08* | (2006.01) |
| *E05B 17/00* | (2006.01) |

(52) U.S. Cl.

CPC ..... *E05B 7/00* (2013.01); *E05B 1/003* (2013.01); *E05B 17/007* (2013.01); *E05B 65/0811* (2013.01); *Y10T 292/57* (2015.04)

(58) Field of Classification Search

CPC ..... E05B 15/02; E05B 53/00; E05B 1/003; E05B 65/0811; E05B 3/06; E05B 63/08

USPC ..... 292/336.3

See application file for complete search history.

(56) References Cited

U.S. PATENT DOCUMENTS

| | | | |
|---|---|---|---|
| 1,251,467 | A | 1/1918 | Blixt et al. |
| 1,716,113 | A | 6/1929 | Carlson |
| 2,535,947 | A | 12/1950 | Newell |
| 2,739,002 | A | 3/1956 | Johnson |

(Continued)

FOREIGN PATENT DOCUMENTS

| | | |
|---|---|---|
| AT | 844928 | 12/1920 |
| DE | 1002656 | 2/1957 |

(Continued)

OTHER PUBLICATIONS

"Intercity Locks—For All Your Security Needs—Fast", http://www.directlocks.co.uk/locks-multipoint-locks-c-123_96.html, accessed Oct. 27, 2011, original publication date unknown, 3 pgs.

(Continued)

*Primary Examiner* — Mark Williams

(57) ABSTRACT

A lock actuation assembly includes an escutcheon and a handle having a first end pivotably connected to the escutcheon at an interface. A link arm is pivotably mounted in the escutcheon and also comprises a first end. A projection is engaged with the first end of the handle and the first end of the link arm. A cam located in the escutcheon is rotatably engaged with a second end of the link arm. The cam includes a tailpiece adapted for engagement with a locking mechanism.

18 Claims, 12 Drawing Sheets

(56) References Cited

U.S. PATENT DOCUMENTS 2,862,750 A 12/1958 Minke
2,910,858 A 11/1959 Jackson
3,064,462 A 11/1962 Ng et al.
3,162,472 A 12/1964 Rust
3,250,100 A 5/1966 Cornaro
3,413,025 A 11/1968 Sperry
3,437,364 A 4/1969 Walters
RE26,677 E 10/1969 Russell et al.
3,586,360 A 6/1971 Perrotta
3,806,171 A 4/1974 Fernandez
3,869,159 A 3/1975 Eads
3,894,759 A 7/1975 Balducci
3,899,201 A 8/1975 Paioletti
3,904,229 A 9/1975 Waldo
3,981,164 A 9/1976 Balducci
4,076,289 A 2/1978 Fellows et al.
4,116,479 A 9/1978 Poe
4,132,438 A 1/1979 Guymer
4,387,917 A 6/1983 Cocker
4,593,542 A 6/1986 Rotondi et al.
4,602,812 A 7/1986 Bourne
4,629,228 A 12/1986 Marko et al.
4,643,005 A 2/1987 Logas
4,691,543 A 9/1987 Watts
4,949,563 A 8/1990 Gerard et al.
4,962,653 A 10/1990 Kaup
4,964,660 A 10/1990 Prevot et al.
4,973,091 A 11/1990 Paulson
5,092,144 A 3/1992 Fleming et al.
5,118,151 A 6/1992 Nicholas, Jr. et al.
5,125,703 A 6/1992 Clancy et al.
5,171,050 A 12/1992 Mascotte
5,172,944 A 12/1992 Munich et al.
5,197,771 A 3/1993 Kaup et al.
5,265,452 A 11/1993 Dawson et al.
5,290,077 A 3/1994 Fleming
5,373,716 A * 12/1994 MacNeil ..... E05C 9/026 292/165
5,382,060 A 1/1995 O'Toole et al.
5,383,060 A * 1/1995 Davis ..... 359/820
5,388,875 A 2/1995 Fleming
5,404,737 A 4/1995 Hotzl
5,482,334 A 1/1996 Hotzl
5,495,731 A 3/1996 Riznik
5,513,505 A 5/1996 Danes
5,516,160 A 5/1996 Kajuch
5,524,941 A 6/1996 Fleming
5,524,942 A 6/1996 Fleming
5,609,372 A 3/1997 Ponelle
5,620,216 A 4/1997 Fuller
5,707,090 A 1/1998 Sedley
5,722,704 A 3/1998 Chaput et al.
5,730,478 A 3/1998 D'Hooge
5,782,114 A 7/1998 Zeus et al.
5,791,700 A 8/1998 Biro
5,820,170 A * 10/1998 Clancy ..... 292/26
5,820,173 A 10/1998 Fuller
5,865,479 A 2/1999 Viney
5,878,606 A 3/1999 Chaput et al.
5,890,753 A 4/1999 Fuller
5,896,763 A 4/1999 Dinkelborg et al.
5,901,989 A 5/1999 Becken et al.
5,906,403 A 5/1999 Bestler et al.
5,951,068 A 9/1999 Strong et al.
6,050,115 A 4/2000 Schroter et al.
6,094,869 A 8/2000 Magoon et al.
D433,916 S 11/2000 Frey
6,196,599 B1 3/2001 D'Hooge
6,209,931 B1 4/2001 Von Stoutenborough et al.
6,217,087 B1 4/2001 Fuller
6,257,030 B1 7/2001 Davis, III et al.
6,264,252 B1 7/2001 Clancy
6,282,929 B1 9/2001 Eller et al.
6,283,516 B1 9/2001 Viney
6,293,598 B1 9/2001 Rusiana
6,502,435 B2 1/2003 Watts et al.
6,516,641 B1 2/2003 Segawa
6,637,784 B1 10/2003 Hauber et al.
6,672,632 B1 1/2004 Speed et al.
6,688,656 B1 2/2004 Becken
6,733,051 B1 5/2004 Cowper
6,776,441 B2 8/2004 Liu
6,810,699 B2 11/2004 Nagy
6,971,686 B2 12/2005 Becken
6,994,383 B2 2/2006 Morris
7,025,394 B1 4/2006 Hunt
7,083,206 B1 8/2006 Johnson
7,249,791 B2 7/2007 Johnson
7,404,306 B2 7/2008 Walls et al.
7,418,845 B2 9/2008 Timothy
7,634,928 B2 12/2009 Hunt
7,677,067 B2 3/2010 Riznik et al.
7,707,862 B2 5/2010 Walls et al.
7,735,882 B2 6/2010 Abdollahzadeh et al.
7,753,418 B2 7/2010 Fleming
7,856,856 B2 12/2010 Shvartz
7,878,034 B2 2/2011 Alber et al.
8,182,002 B2 5/2012 Fleming
8,348,308 B2 1/2013 Hagemeyer et al.
8,376,414 B2 2/2013 Nakanishi et al.
8,382,166 B2 2/2013 Hagemeyer et al.
8,398,126 B2 3/2013 Nakanishi et al.
8,424,928 B2 4/2013 Lin
8,448,996 B2 * 5/2013 Lake ..... E05B 7/00 292/111
2003/0159478 A1 * 8/2003 Nagy ..... 70/107
2004/0107746 A1 6/2004 Chang
2004/0239121 A1 12/2004 Morris
2005/0103066 A1 5/2005 Botha et al.
2006/0202491 A1 9/2006 Engel et al.
2007/0080541 A1 4/2007 Fleming
2007/0113603 A1 5/2007 Polster
2007/0170725 A1 7/2007 Speyer et al.
2008/0087052 A1 4/2008 Abdollahzadeh et al.
2008/0092606 A1 4/2008 Meekma
2008/0141740 A1 6/2008 Shvartz
2008/0156048 A1 * 7/2008 Topfer ..... 70/77
2008/0156049 A1 7/2008 Topfer
2008/0178530 A1 7/2008 Ellerton et al.
2008/0179893 A1 7/2008 Johnson
2008/0184749 A1 8/2008 Alber et al.
2009/0078011 A1 3/2009 Avni
2010/0154490 A1 6/2010 Hagemeyer et al.
2010/0213724 A1 8/2010 Uyeda
2010/0236302 A1 9/2010 Uyeda
2011/0198867 A1 8/2011 Hagemeyer et al.
2011/0289987 A1 12/2011 Chiou et al.
2012/0146346 A1 6/2012 Hagemeyer et al.
2013/0019643 A1 1/2013 Tagtow et al.
2013/0200636 A1 8/2013 Hagemeyer et al.

FOREIGN PATENT DOCUMENTS

DE 1584112 9/1969
DE 2639065 3/1977
DE 9011216 10/1990
DE 4224909 2/1993
DE 29807860 8/1998
DE 102010029985 A1 12/2011
EP 341173 11/1989
EP 359284 3/1990
EP 661409 7/1995
EP 792987 9/1997
EP 1106761 6/2001
EP 1867817 12/2007
EP 1953311 A2 8/2008
EP 2107189 A1 10/2009
EP 2128362 12/2009
FR 1142316 3/1957
FR 2339723 9/1977
FR 2342390 9/1977
GB 226170 4/1925
GB 1498849 1/1978
GB 1575900 10/1980

(56) References Cited

FOREIGN PATENT DOCUMENTS

| | | |
|---|---|---|
| GB | 2051214 | 1/1981 |
| GB | 2076879 | 12/1981 |
| GB | 2122244 | 1/1984 |
| GB | 2126644 | 3/1984 |
| GB | 2134170 | 8/1984 |
| GB | 2136045 | 9/1984 |
| GB | 2168747 | 6/1986 |
| GB | 2196375 | 4/1988 |
| GB | 2212849 | 8/1989 |
| GB | 2225052 | 5/1990 |
| GB | 2230294 | 10/1990 |
| GB | 2242702 | 10/1991 |
| GB | 2244512 | 12/1991 |
| GB | 2265935 | 10/1993 |
| GB | 2270343 | 3/1994 |
| GB | 2280474 | 2/1995 |
| GB | 2364545 | 1/2002 |
| IT | 614960 | 1/1961 |
| SE | 309372 | 3/1969 |
| WO | 96/25576 | 8/1996 |
| WO | 2007/104499 | 9/2007 |
| WO | 2011/154723 A1 | 12/2011 |

OTHER PUBLICATIONS

"Intercity Locks—For All Your Security Needs—Fast", http://www.directlocks.co.uk/locks-multipoint-locks-c-123_96.html?page=2&sort=2A, accessed Oct. 27, 2011, original publication date unknown, 3 pgs.

"Intercity Locks—For All Your Security Needs—Fast", http://www.directlocks.co.uk/locks-multipoint-locks-c-123_96.html?page=3&sort=2A, accessed Oct. 27, 2011, original publication date unknown, 3 pgs.

"LocksOnline.co.uk: Premier Supplier of Security Products", http://www.locksonline.co.uk/acatalog/Maco_multipoint_lock_2_cams_2_shootbolt_attachment.html, accessed Oct. 27, 2011, original publication date unknown, 5 pgs.

"LocksOnline.co.uk: Premier Supplier of Security Products", http://www.locksonline.co.uk/acatalog/upvc_Locks.html, accessed Oct. 27, 2011, original publication date unknown, 6 pgs.

"uPVC Window Hardware and uPVC Door Hardware online", http://www.upvc-hardware.co.uk/, accessed Oct. 27, 2011, original publication date unknown, 2 pgs.

* cited by examiner

HANDLE-ACTUATED SLIDING DOOR LOCK ACTUATION ASSEMBLIES

CROSS-REFERENCE TO RELATED APPLICATIONS

This application claims priority to and the benefit of U.S. Provisional Patent Application Ser. No. 61/661,081, filed Jun. 18, 2012, entitled "Handle-actuated Sliding Door Lock Actuation Assemblies," the disclosure of which is hereby incorporated by reference herein in its entirety.

INTRODUCTION

Many locks for sliding doors, for example, patio doors, utilize both a fixed handle for moving the door and a pivotable thumbturn or other actuation device for locking and/or latching the door. Often, a fixed handle and a pivotable thumbturn are used to move and lock the door, respectively. In many such assemblies, the position of the thumbturn and, accordingly, the latch or lock element, may be difficult to ascertain. In such cases, an operator may believe the door to be locked when it is actually not so. Additionally, thumbturns are often small (so as to not detract from door aesthetics) and may be difficult for an operator to manipulate. This may be especially true in the case of a disabled operator who may have difficulty grasping, pinching, or rotating the thumbturn. To address this, the Americans with Disabilities Act (ADA) requires that an ADA-compliant door must be able to be opened and closed with less than five pounds of force applied to the locking element actuator (that is, the thumbturn). Lengthening an arm on the thumbturn may increase the moment applied to the thumbturn, but a longer arm can be unsightly, and may interfere with the handle of the door.

SUMMARY

In one aspect, the technology relates to a lock actuation assembly including: an escutcheon; a handle comprising a first end pivotably connected to the escutcheon at an interface; a link arm pivotably mounted in the escutcheon, the link arm comprising a first end; a projection engaged with the first end of the handle and the first end of the link arm; and a cam located in the escutcheon, wherein the cam is rotatably engaged with a second end of the link arm, the cam comprising a tailpiece adapted for engagement with a locking mechanism. In an embodiment, the interface has an interface axis and the tailpiece has a tailpiece axis, wherein the cam pivots about the tailpiece axis, and wherein the interface axis and the tailpiece axis are parallel. In another embodiment, the handle is pivotable between a first handle position and a second handle position, the link arm is pivotable between a first link arm position and a second link arm position, the cam is pivotable between a first cam position and a second cam position, and when the handle is in the first handle position, the link arm is in the first link arm position, and the cam is in the first cam position. In yet another embodiment, the lock actuation assembly includes a rivet for rotatably engaging the second end of the link arm with the cam. In still another embodiment, an angle between the first handle position and the second handle position is from about 5 degrees to about 20 degrees. In another embodiment the angle is about 11 degrees.

In an embodiment of the above aspect, the link arm defines an opening for receiving a mounting element, wherein the mounting element is adapted to mount the lock actuation assembly onto a stile of a door. In another embodiment, the projection is integral with at least one of the handle and the link arm. In yet another embodiment, the lock actuation assembly further includes a stop for limiting a pivoting range of the handle. In still another embodiment, the stop slidably engages a second end of the handle with the escutcheon.

In another aspect, the technology relates to a lock actuation assembly including: an escutcheon; a handle comprising a first handle end pivotably connected to the escutcheon at an interface, wherein the first handle end is pivotable about an interface axis; and a cam disposed in the escutcheon and operably connected to the handle, wherein the cam comprises a tailpiece adapted for engagement with a locking mechanism, wherein the tailpiece is pivotable about a tailpiece axis that is substantially parallel to the interface axis. In an embodiment, the lock actuation assembly further includes a link arm comprising a first link arm end and a second link arm end, wherein the first link arm end is fixedly engaged with the handle, and wherein the second link arm end is pivotably engaged with the cam, such that a rotation of the handle rotates the cam. In another embodiment, the handle is pivotable between a rest position and a stop position. In yet another embodiment, the lock actuation assembly further includes a stop for preventing a pivoting of the handle past the stop position. In still another embodiment, the stop extends from the handle and is slidably engaged with a slot defined by the escutcheon.

In another embodiment of the above aspect, the stop extends from a second end of the handle. In yet another embodiment, the link arm has a taper from the first link arm end to the second link arm end, and wherein the link arm has a first tapered edge and a second tapered edge. In still another embodiment, when the link arm is in a first position, the first tapered edge is substantially parallel to an escutcheon axis, and wherein when the link arm is in a second position, the second tapered edge is substantially parallel to the escutcheon axis.

In another aspect, the technology relates to a kit useful in forming a lock actuation assembly, the kit including: an escutcheon adapted to be secured to a stile of a door; a handle comprising a first end, wherein the first end is adapted to be pivotably connected to the escutcheon at an interface; a link arm adapted to be pivotably received in the escutcheon, the link arm comprising a first end; a projection adapted to engage the first end of the handle with the first end of the link arm; and a cam adapted to be pivotably received in the escutcheon, wherein the cam is adapted to be rotatably engaged with a second end of the link arm, the cam comprising a tailpiece adapted for engagement with a locking mechanism. In an embodiment, the kit includes a stop adapted to be fixed to at least one of the handle and the escutcheon.

BRIEF DESCRIPTION OF THE DRAWINGS

There are shown in the drawings, embodiments which are presently preferred, it being understood, however, that the technology is not limited to the precise arrangements and instrumentalities shown.

DETAILED DESCRIPTION

Figure 1A:
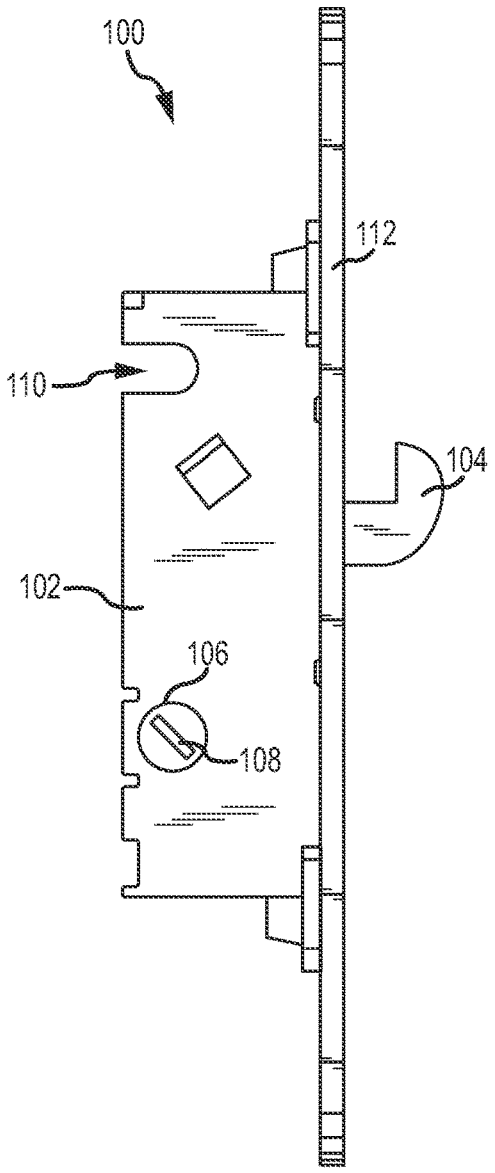
FIGS. 1A and 1B are side views of a lock mechanism in a locked position and an unlocked position, respectively.
Figure 1B:
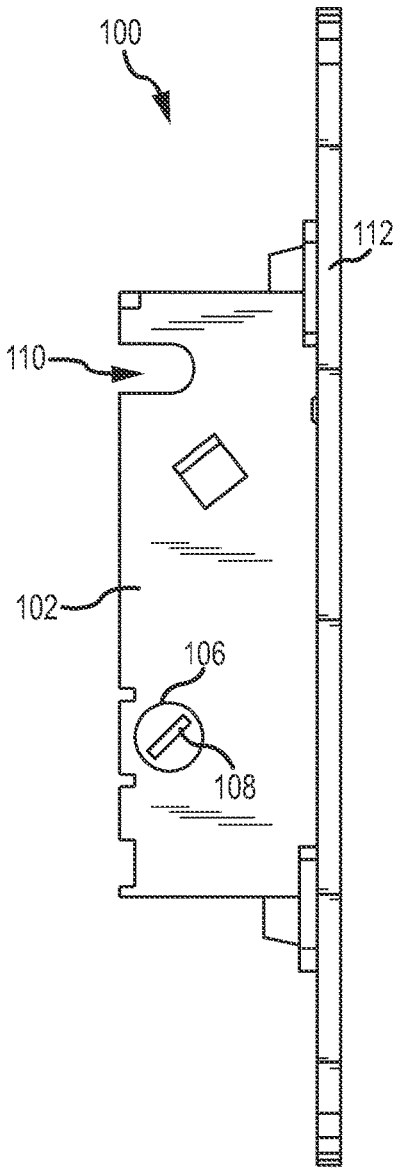

FIGS. 1A and 1B are side views of a lock mechanism 100 in a locked position and an unlocked position, respectively. The lock mechanism 100 may be installed in a stile of a sliding door, for example, a sliding glass door. The lock mechanism may be the 537 series lock, sold by Amesbury Group, Inc.—Door Hardware Division, of Sioux Falls, S. Dak., or similar one- or two-point locks. Other lock mechanisms may also be utilized, such as, for example, the two-point lock mechanism described in U.S. Pat. No. 7,418,845, the disclosure of which is hereby incorporated by reference herein in its entirety. The depicted lock mechanism 100 includes a housing 102 and a locking member 104 pivotally connected thereto. An actuator 106 is engaged with the locking member 104 and includes an actuator slot 108 for receipt of a tailpiece from a lock actuation assembly. The lock housing 102 may define one or more openings 110 for allowing passage of an escutcheon mounting element (for example, a screw or a bolt) therethrough. Additionally, a faceplate 112 may be secured to the housing 102 and used to secure the locking mechanism 100 to a door stile. FIG. 1A depicts the locking element 104 in an extended or locked position. FIG. 1B depicts the locking element 104 in the retracted or unlocked position. The orientation of the actuator slot 108 corresponds to one of these two positions. In the depicted embodiment, the actuator 106 rotates or pivots about 90 degrees between the locked and unlocked positions.

Figure 2A:
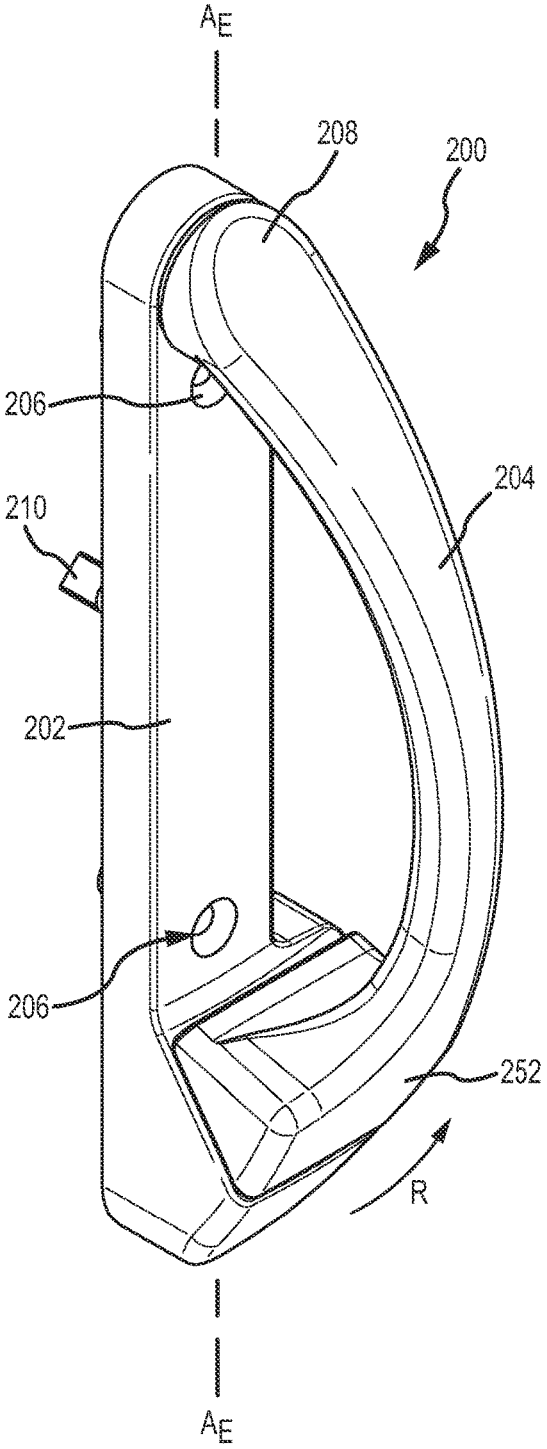
FIGS. 2A and 2B are perspective views of an embodiment of a lock actuation assembly.
Figure 2B:
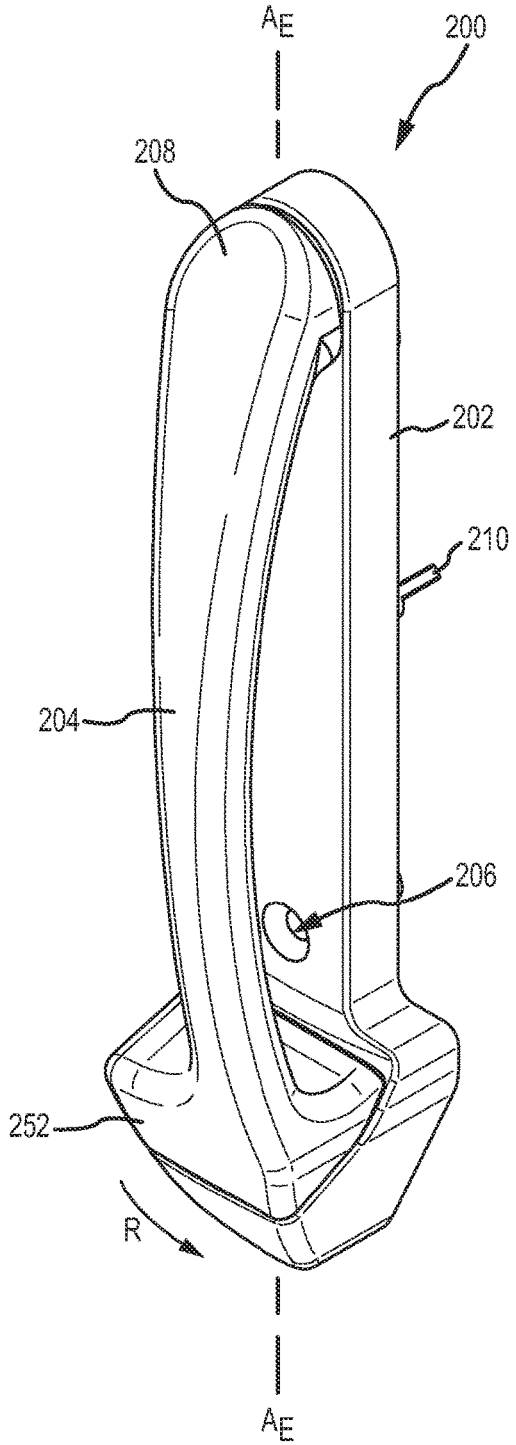

FIGS. 2A and 2B are perspective views of an embodiment of a lock actuation assembly 200 in a first or locked position. The lock actuation assembly 200 includes an escutcheon 202 and a handle 204 pivotably connected to the escutcheon 202. The escutcheon 202 defines an escutcheon axis $A_E$, which extends generally the length of the escutcheon 202. In the depicted embodiment, the escutcheon axis $A_E$ is defined by two openings 206 in the escutcheon 202. The openings 206 are configured to receive a bolt, screw, or other elongate fastening elements that secure the lock actuation assembly 200 to a door. In other embodiments, the escutcheon axis $A_E$ may be defined by an edge or some other portion of the escutcheon 202. The handle 204 is pivotably connected to the escutcheon 202 at a first end 208 of the handle 204. When in the first handle position, as depicted, a second end 252 of the handle 204 may be located proximate the escutcheon 202, such that when viewed from the front or side, the handle 204 may appear aligned or integral with the escutcheon 202. A rotation R of the handle 204 moves the lock actuation assembly 200 to a second or an unlocked position. In this second handle position (depicted below), the second end 252 is located distal from or misaligned with the escutcheon 202. This rotation R also rotates a tailpiece 210, which extends into a slot of an actuator of a locking mechanism when the lock actuation assembly is mounted on a door. The door and lock mechanism are not shown, as the installation would be apparent to a person of skill in the art. Mechanisms that enable for the rotation of the tailpiece 210 are described in further detail herein.

Figure 3A:
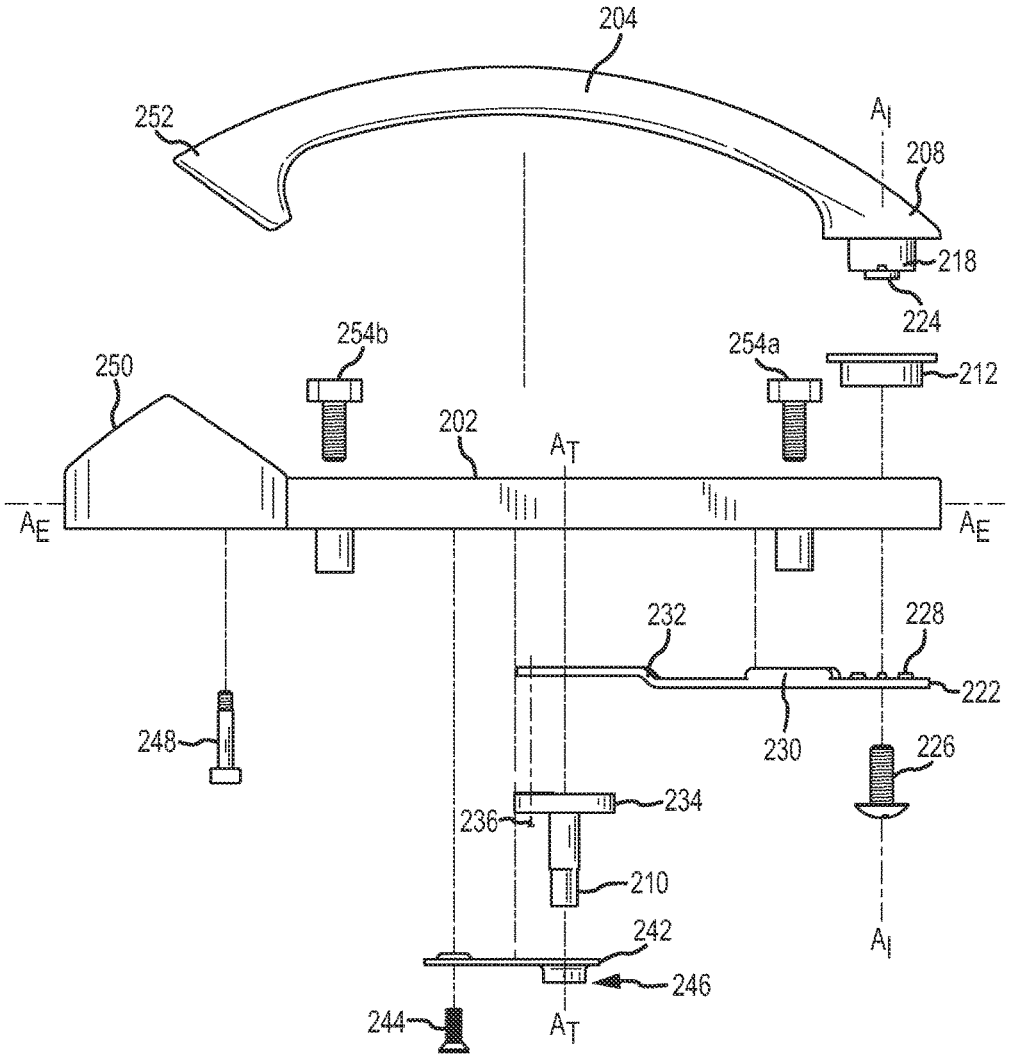
FIGS. 3A and 3B are an exploded side view and an exploded perspective view, respectively, of an embodiment of a lock actuation assembly.
Figure 3B:
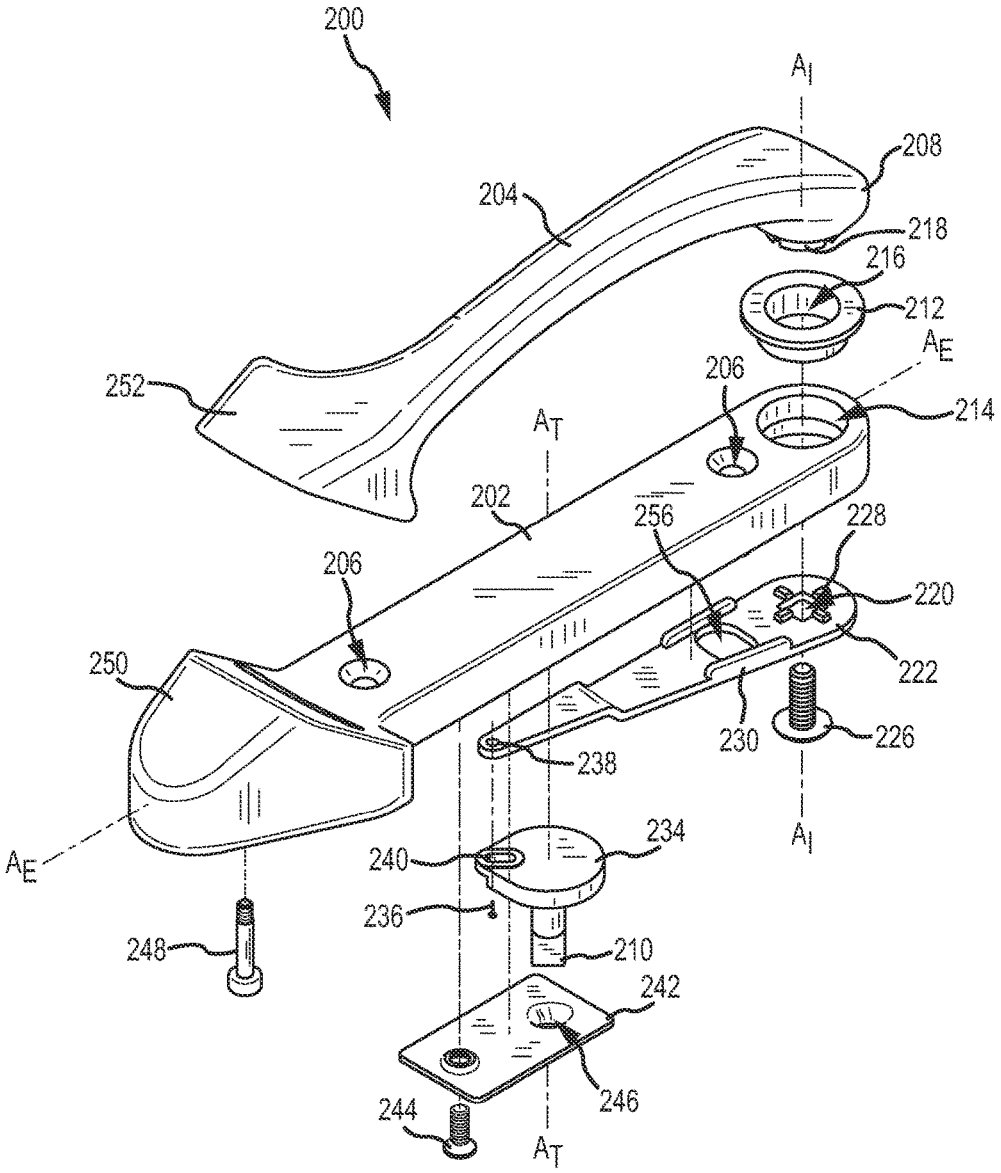

FIGS. 3A and 3B depict an exploded side view and an exploded perspective view, respectively, of an embodiment of a lock actuation assembly 200. Common elements described with regard to FIGS. 2A and 2B above include the escutcheon 202 with the openings 206 defined therethrough, the handle 204 having an upper end 208, and the tailpiece 210. The handle 204 is pivotably connected at the upper end 208 to the escutcheon 202 utilizing a low-friction bushing 212 that fits within an interface 214 defined by the escutcheon 202. Anti-friction axial and/or thrust bearings may alternatively be used in place of the bushing 212. The bushing 212 defines an opening 216 that receives a projection 218 from an underside of the handle 204. In another embodiment, the projection 218 or interface 214 may be manufactured from a low-friction material. At least a portion of the projection 218 is configured to penetrate a similarly-sized and -dimensioned keyway 220 of a link arm 222, such that rotation of the handle 204 will rotate the link arm 222. In the depicted embodiment, a square key 224 extends from the projection 218 and into the keyway 220, although other shapes, such as cross, hexagon, triangle, etc., may be used. A fastener 226, here in the form of a screw, may be used to further secure the link arm 222 to the handle 204.

The link arm 222 is configured so as to fit within the escutcheon 202 when installed. In addition to the keyway 220/key 224 connection, the depicted link arm 222 may include a number of detents 228 that may further engage matching recesses on the projection 218. Once the fastener 226 is fixed, these detents 228 will further help limit play between the handle 204 and the link arm 222. The link arm 222 further includes a number of tabs 230, which are described in more detail below. Additionally, one or more bends 232 may be formed on the link arm to ensure clearance between the various components. The bend 232 depicted in FIGS. 3A and 3B limits interference between the link arm 222 and a cam 234, aspects of which are described in more detail below. The tailpiece 210 extends from the cam 234 and is configured to be received within the actuator of a lock mechanism. A rivet, pin, or other pivotable connector 236 passes through an opening 238 on the end of the link arm 222 and a slot 240 on the cam 234, so as to pivotably connect the cam 234 and link arm 222.

A retention plate 242 may be fastened to the escutcheon 202 with a screw, bolt, or other fastener 244 so as to keep the cam 234 positioned within the escutcheon 202. The retention plate 242 defines an opening 246 through which the tailpiece 210 extends. The depicted lock actuation assembly 200 also includes a stop 248 in the form of a pin that extends from a lower portion 250 of the escutcheon 202 and is secured to a lower portion 252 of the handle 204. The operation of the stop 248 is described in more detail below. A number of axes are depicted in FIGS. 3A and 3B. As described above, the escutcheon 202 includes an escutcheon axis $A_E$. An interface axis $A_I$ defines an axis about which the handle 204 rotates. In the depicted embodiment, the interface axis $A_I$ may be defined by the fastener 226. A tailpiece axis $A_T$ defined by the tailpiece 210 is substantially parallel to the interface axis $A_I$ and both the tailpiece axis $A_T$ and the interface axis $A_I$ are substantially orthogonal to the escutcheon axis $A_E$. Accordingly, unlike sliding door locks that utilize a thumbturn to pivot a tailpiece about a single axis and thus actuate a lock mechanism, the present technology allows rotation of the tailpiece 210 (about a first axis) by rotation of a handle (about a second axis). Since the handle 204 is significantly longer than thumbturns of prior art mechanisms, the moment achieved allows the lock actuation assembly 200 to be more easily actuated, especially by those users with limited strength or gripping ability.

As apparent from the description, several of the elements of the lock actuation assembly 200 are located on an underside of the escutcheon 202 and thus would not be visible once installed. The escutcheon 202 is secured onto a stile of a door with one or more mounting elements 254, such as screws, bolts, or other securing devices that penetrate the openings 206. In the depicted embodiment, an upper mounting element 254*a* is located proximate the upper end 208 of the handle 204. A second securing element 254*b* is located proximate a lower portion 252 of the handle 204. Of course, the mounting elements 254 may be located on the escutcheon 202 as required or desired for a particular application. The mounting elements 254 may penetrate the locking mechanism, and may be secured to an escutcheon located on an opposite side of the door. Additionally, the upper mounting element 254*a* passes through a mounting element opening 256 defined by the lever arm 222. The lock actuation assembly 200 is typically located on an interior side of the door. The escutcheon 202 serves an aesthetic function and may be of various designs and/or configurations to complement the handle 204.

Figure 4C:
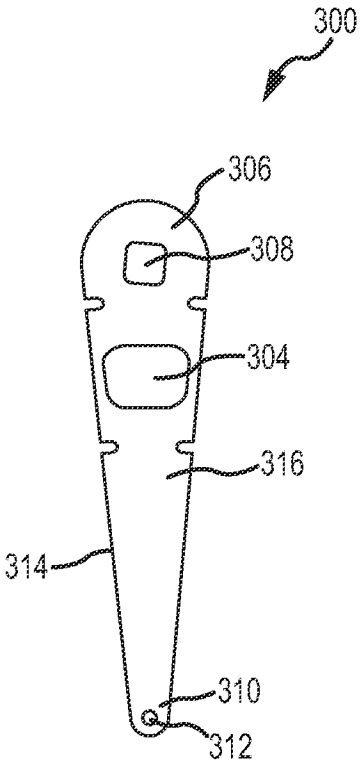
FIGS. 4A-4C are front, side, and rear views, respectively, of an embodiment of a link arm utilized in a lock actuation assembly.
Figure 4B:
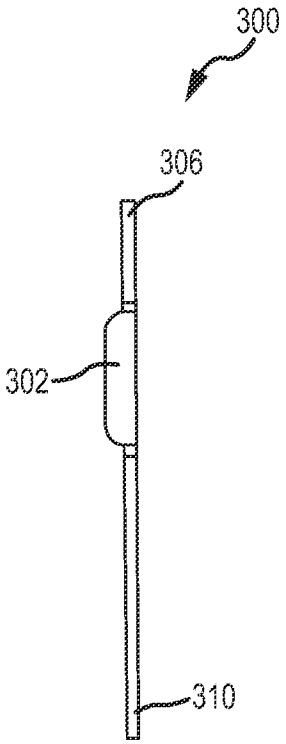
Figure 4A:
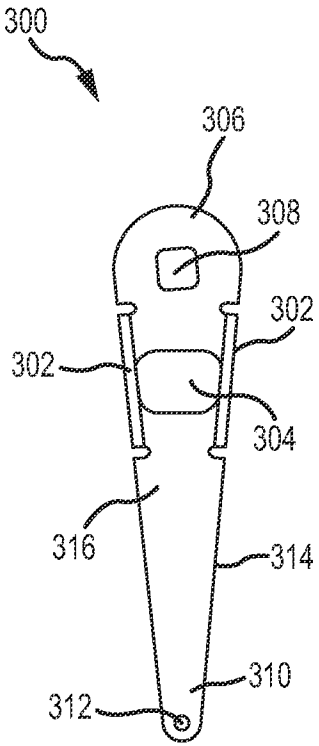
Figure 5D:
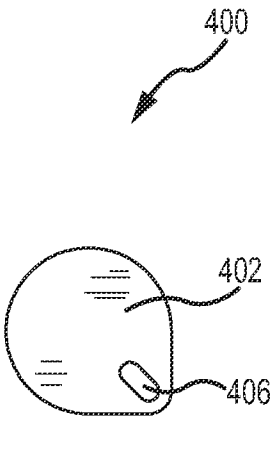
FIGS. 5A-5D are first side, rear, second side, and front views, respectively, of an embodiment of a cam utilized in a lock actuation assembly.
Figure 5C:
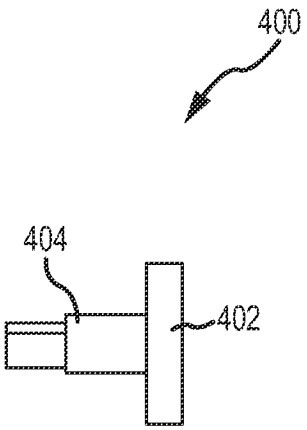
Figure 5B:
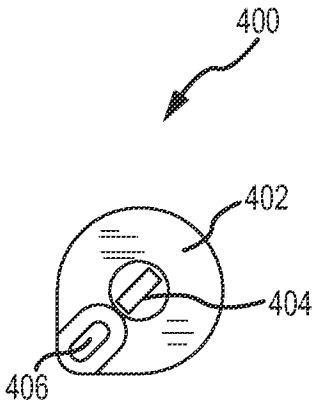
Figure 5A:
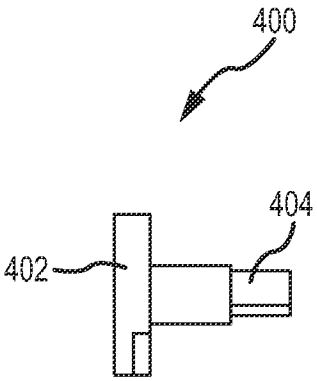

FIGS. 4A-4C are front, side, and rear views, respectively, of another embodiment of a link arm 300 utilized in lock actuation assemblies such as the types described herein. The link arm 300 shares structural similarities with the link arm 222 depicted in FIGS. 3A and 3B. Additional aspects and functionality are now described with reference to FIGS. 4A-4C. The link arm 300 includes a plurality of tabs 302 that help maintain forward/backward alignment of the link arm 300 (that is, with respect to an escutcheon). Also, the tabs 302 reinforce the link arm 300 against twisting or bending forces. Although the tabs 302 are shown on either side of the mounting element opening 304, they may be located anywhere along the link arm 300, or need not be included at all. In such a case, it may be desirable to utilize a thicker gauge material for the link arm 300, to resist undesirable bending or twisting forces. A first end 306 of the link arm 300 defines a keyway 308 that is used to engage a discrete projection from the handle. A second end 310 of the link arm 300 defines an opening 312 for receipt of a pivotable connector. The link arm 300, as well as the link arm 222 of FIGS. 3A and 3B, define a substantially tapered shape, which allows the link arm to pivot within the escutcheon while maintaining sufficient clearance therein. Edges 314, 316 define a decreasing taper from the first end 306 to the second end 310.

FIGS. 5A-5D are first side, rear, second side, and front views, respectively, of a cam 400 utilized in lock actuation assemblies such as the types described herein. The cam 400 shares structural similarities with the cam 234 depicted in FIGS. 3A and 3B. Additional aspects and functionality are now described with reference to FIGS. 5A-5D. The cam 400 includes a base 402 and a tailpiece 404 extending substantially orthogonally therefrom. The tailpiece 404 is configured so as to engage the actuator slot of a locking mechanism actuator, such as the type depicted in FIGS. 1A and 1B. The base 402 defines a slot 406 configured to receive a pivotable connection such as the rivet or pin described above. The length of the slot 406 allows the rivet to move radially along the base 402 as the connected link arm rotates the cam 400 from a first cam position (depicted in FIG. 7A) to a second cam position (depicted in FIG. 7B). In an alternative embodiment, the cam may include a projection projecting from the base that may engage with an elongate opening on the link arm.

Figure 6A:
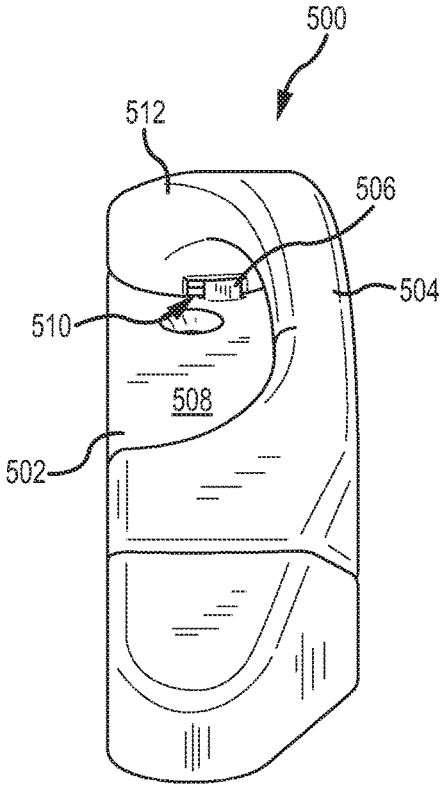
FIGS. 6A and 6B are bottom perspective views of an embodiment of a lock actuation assembly in a locked position and an unlocked position, respectively.
Figure 6B:
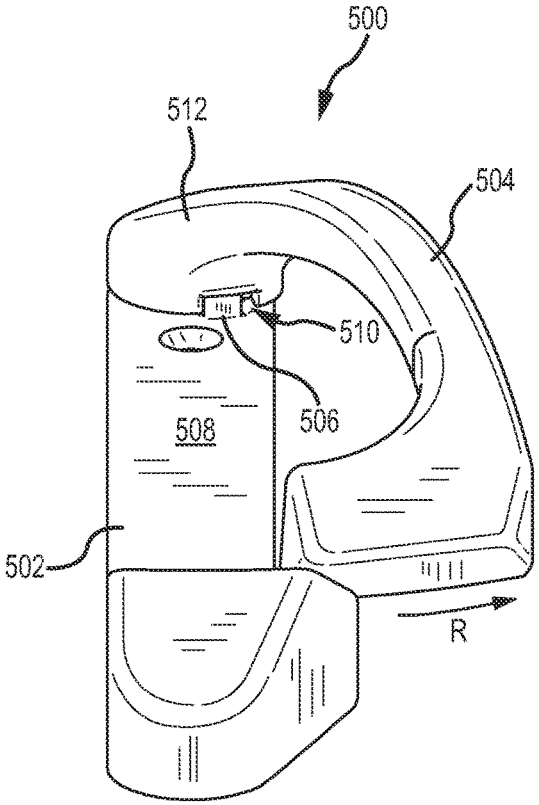

FIGS. 6A and 6B are bottom perspective views of an embodiment of a lock actuation assembly 500 in a locked position and an unlocked position, respectively. The lock actuation assembly 500 includes an escutcheon 502 and a handle 504 pivotably connected thereto. In order to prevent over-rotation of the handle 504 during operation, the lock actuation assembly 500 includes a stop 506. Here, the stop projects from a front surface 508 of the escutcheon 502. A recess 510 is formed in an upper portion 512 of the handle and receives the stop 506. When the handle 504 is in the first position depicted in FIG. 6A, the stop 506 may abut a first side of the recess 510. As the handle 504 is pulled or rotated R, the stop 506 abuts a second side of the recess 510, and over-rotation of the handle 504 is prevented. In an alternative embodiment, the recess may be formed in the escutcheon and a stop may project into the recess from the handle. The recess 510 and stop 506 are located so as to be hidden from view, thus preventing these elements from detracting from handle design aesthetics. Locating the stop and recess as depicted also helps reduce the likelihood of a user's fingers being pinched between the handle 504 and stop 506 during use.

Figure 6D:
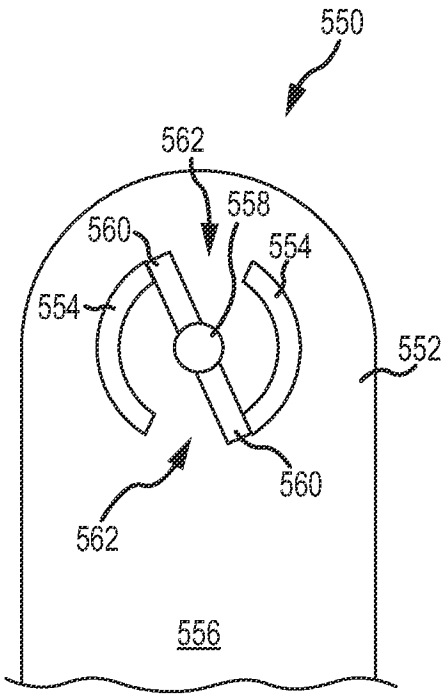
FIGS. 6C and 6D are cross-sectional views of an embodiment of a stop system utilized in a lock actuation assembly.
Figure 6C:
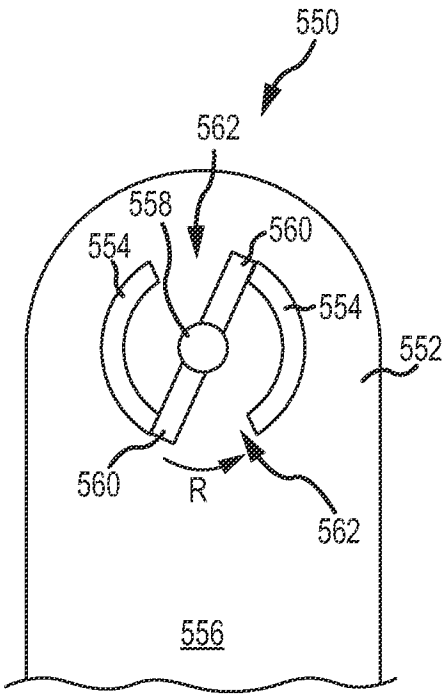

FIGS. 6C and 6D are cross-sectional views of an alternative embodiment of stop system 550 utilized in a lock actuation assembly. Here, an escutcheon 552 includes one or more walls 554 extending from a front surface 556 thereof. A handle (not shown) is pivotably engaged with the escutcheon 552 as described herein. The handle includes a projection 558 that allows for pivoting movement of the handle relative to the escutcheon 552. In that regard, the projection 558 is similar to the projection 218 described in FIGS. 3A and 3B. When in a first position, depicted in FIG. 6C, one or more stops 560 may abut or nearly abut the walls 554 from the escutcheon 552. As the handle is rotated R, the stops move in an arcuate motion within a gap 562 between the walls 554. In the second position, depicted in FIG. 6D, the stops 560 abut the escutcheon walls 554, preventing further rotation thereof. Other configurations of stop systems located at the interface between the handle and escutcheon are contemplated.

Figure 6F:
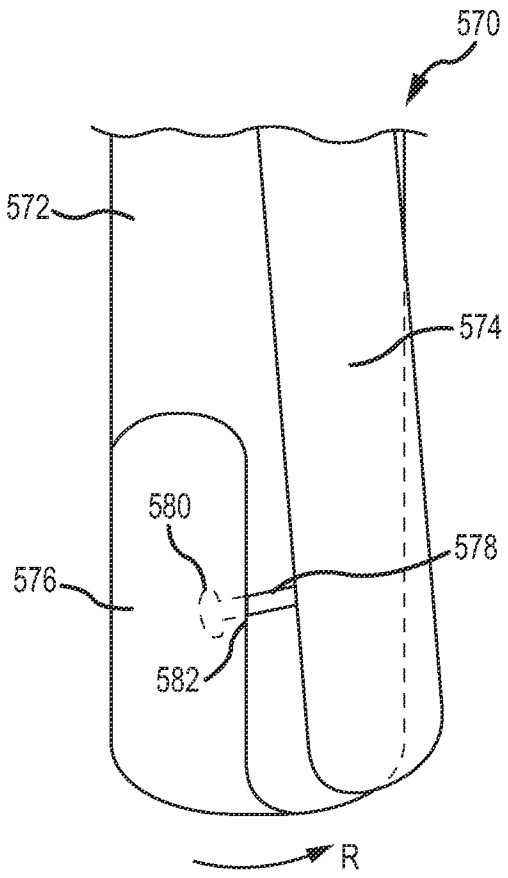
FIGS. 6E and 6F are front views of an embodiment of a stop system utilized in a lock actuation assembly.
Figure 6E:
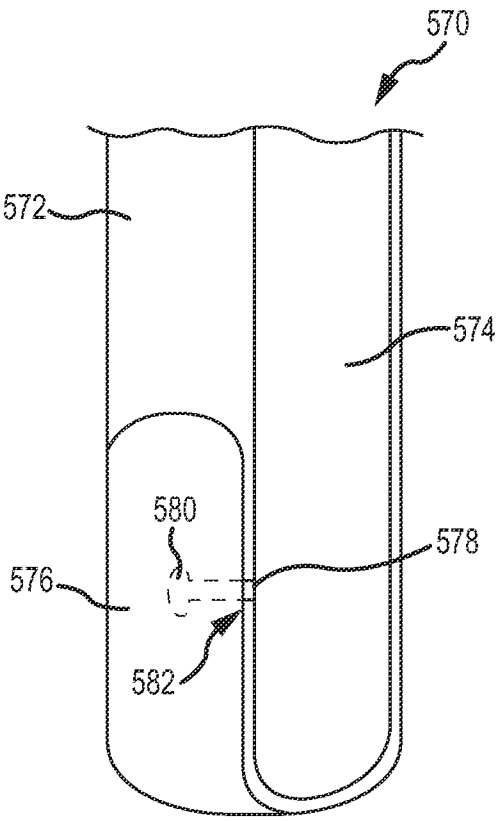

FIGS. 6E and 6F are partial front views of an alternative embodiment of a stop system utilized in a lock actuation assembly 570, in a locked position and an unlocked position, respectively. Here, the lock actuation assembly 570 includes an escutcheon 572 and a handle 574 connected thereto. In these figures, a bottom portion of the assembly 570 is depicted. The escutcheon 572 includes a raised portion 576 that aligns with the handle 574. A pin 578 is fixed to the handle 574 and penetrates an opening in a sidewall 582 of the raised portion 576. As the handle 574 is rotated to the position depicted in FIG. 6F, the pin 578 moves until an enlarged portion 580 of the pin 578 contacts the opening in the sidewall 582. This stops further rotation of the handle 574. Of course, in other embodiments, the pin may be fixed to the raised portion 576 of the escutcheon 572, with the enlarged portion extending into the handle 574. Regardless of the type of stop system utilized, when the handle is in the position depicted in e.g., FIG. 7A, the stop may be referred to as being in the rest position. When the handle is in the position depicted in e.g., FIG. 7B, the stop may be referred to as being in the stop position.

Figure 7A:
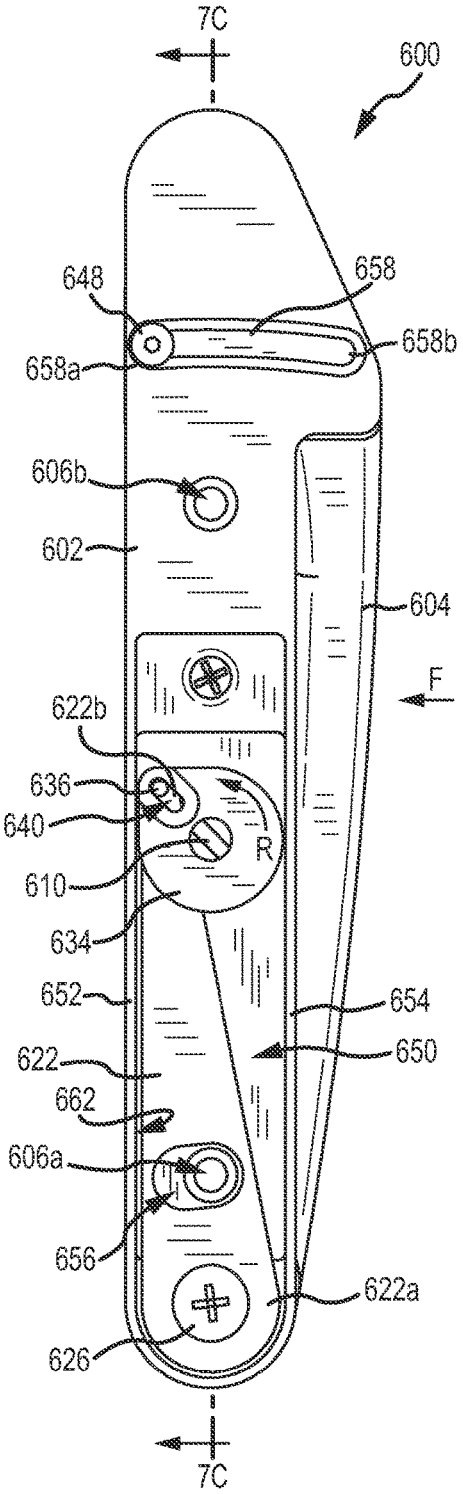
FIGS. 7A and 7B are rear views of an embodiment of a lock actuation assembly in a locked position and an unlocked position, respectively.
Figure 7B:
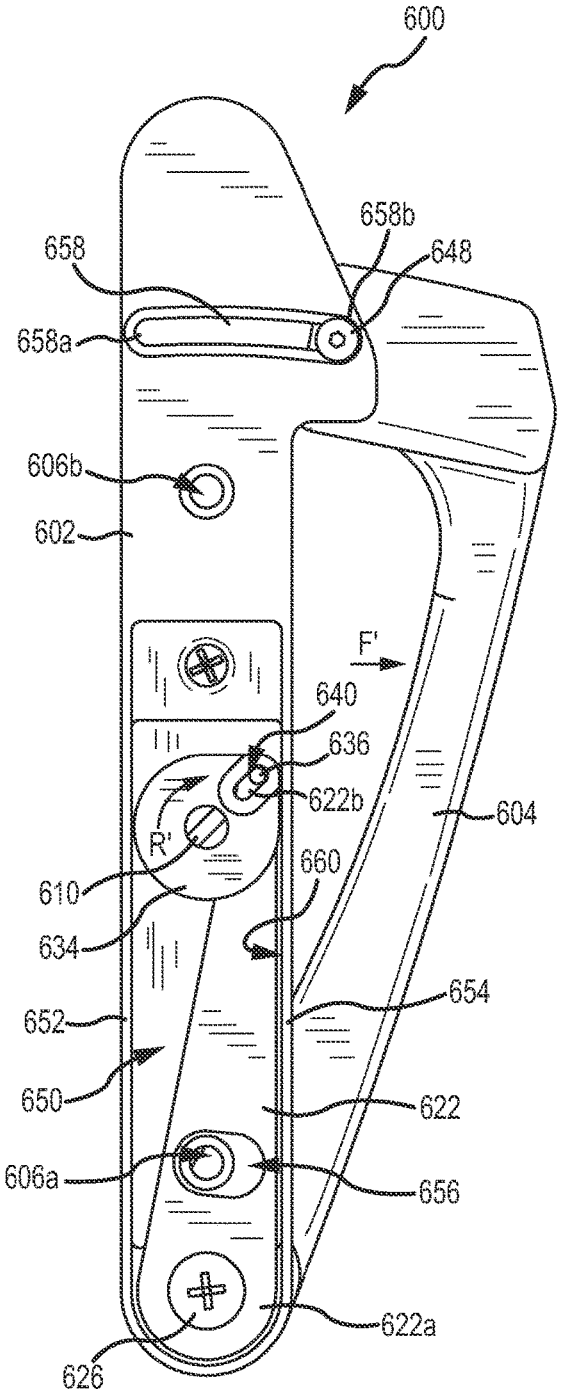

FIGS. 7A and 7B are rear views of an embodiment of a lock actuation assembly 600 in a locked position and an unlocked position, respectively. The figure does not depict a retention plate of the type depicted in FIGS. 3A and 3B, but such an element may be utilized if required or desired for a particular application. The lock actuation assembly 600 includes an escutcheon 602 and a handle 604 pivotably connected thereto. The escutcheon 602 defines a plurality of openings 606 for receiving fasteners used to mount the lock actuation assembly 600 to a door. Opening 606*a* is disposed such that an associated fastener passes through a mounting element opening 656 defined by the link arm 622. As can be seen, the mounting element opening 656 is sized and configured so as to accommodate the fastener for the entire range of motion of the handle 604 and link arm 622.

Walls 652, 654 of the escutcheon 602 define a recess 650. The link arm 622 is located within the recess 650 of the escutcheon 602 and transfers rotational motion from the handle 604 to the cam 634. The length and tapered shape of the link arm 622 determines, in part, the angle of rotation of the handle 604. The link arm 622 is secured at a first end 622*a* to the handle 604 with a screw, bolt, or other fastener 626. The cam 634 is engaged with a second end 622*b* of the link arm 622 via a pin, rivet, or other projection 636 that extends into a slot 640 defined by the cam 634. The cam 634 is also located within the recess 650. The cam 634 includes a tailpiece 610 that is inserted into an actuator slot 108 (FIGS. 1A-1B) of a lock mechanism and rotates an actuator to lock and unlock the lock mechanism (that is, to extend and retract a pivoting locking member). In FIG. 7A, the handle, 604, the link arm 622, and the cam 634 are located in first positions. Second respective positions are depicted in FIG. 7B.

A stop 648 is fixed to the handle 604 and limits rotation of the handle 604 during opening and closing operations of the associated door. In FIG. 7A, the stop 648 is located at a first end 658*a* of a slot 658. Thus, a force F applied to the handle 604 (for example, during a closing of the associated door) is transferred to the escutcheon 602 at both ends of the handle 604, thus preventing over-rotation thereof. That is, a first component of the force F is transferred at a first end 608 of the handle 604 via the projection that connects the handle 604 to the escutcheon 602. A second component of the force F is transferred at a second end 652 of the handle 604 via the stop 648 and the slot 658. Distribution of this force F to both ends of the handle 604 thus prevents over-rotation. In FIG. 7B, the stop 648 is located at a second end 658*b* of the slot 658. Thus, a force F' applied to the handle 604 (for example, during an opening of the associated door) is transferred to the escutcheon 602 at both ends of the handle 604, thus preventing over-rotation thereof. That is, a first component of the force F' is transferred at a first end 608 of the handle 604 via the projection that connects the handle 604 to the escutcheon 602. A second component of the force F' is transferred at the second end 652 of the handle 604 via the stop 648 and the slot 658. Distribution of this force F' to both ends of the handle 604 thus prevents over-rotation. In the depicted embodiment, the slot 658 is slightly arcuate, though any slot configuration may be utilized.

The lock actuation assemblies depicted herein automatically unlock and lock an associated lock mechanism (such as the type depicted in FIGS. 1A and 1B) when the handle is used to pull or push (by sliding) the door open or closed. The lock actuation assembly eliminates the need for a separate locking action (typically rotation of a discrete thumbturn) when the door is unlocked before the door can be opened. The assembly also eliminates the separate locking action required to lock the door lock when the door is closed. The actuation assembly may be used on the interior or exterior of the door stile, but is usually located on the interior. The assembly captures the intuitive motion or action of pulling or pushing (open or closed) a sliding door handle. Referring to the assembly of FIG. 7B, applying a force F' (e.g., by pulling) the handle 604 causes the handle 604 to rotate slightly. This also rotates the link arm 622 to a position such that a first tapered edge 660 of the link arm 622 is substantially parallel with the wall 654 of the escutcheon 602. This pivoting of the link arm 622, in turn, rotates R' the cam 634 clockwise, which rotates the tailpiece 610 to unlock the lock mechanism. Referring to the assembly of FIG. 7A, applying a force F (e.g., by pushing) the handle 604 causes the handle 604 to again rotate slightly. This also rotates the link arm 622 to a position such that a second tapered edge 662 of the link arm 622 is substantially parallel with the opposite wall 652 of the escutcheon 602. This pivoting of the link arm 622, in turn, rotates R the cam 634 counterclockwise, which rotates the tailpiece 610 to lock the lock mechanism.

Figure 7C:
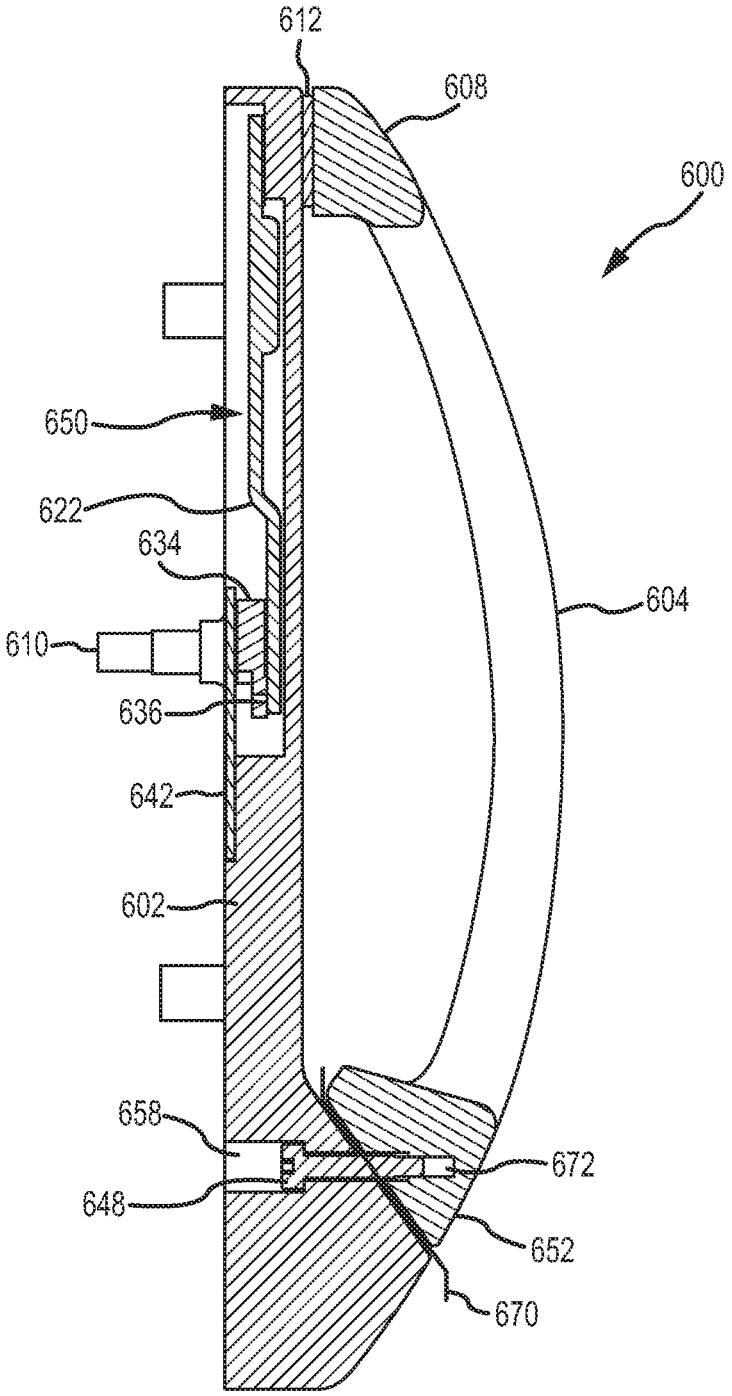
FIG. 7C is a sectional view of an embodiment of a lock actuation assembly.

FIG. 7C is a sectional view of a lock actuation assembly 600', substantially similar to the lock actuation assembly 600 of FIG. 7A. The section line is depicted in FIG. 7A for reference. In this embodiment, the lock actuation assembly 600' includes an escutcheon 602 and a handle 604 having a first end 608 and a second end 652. The handle 604 is connected at the first end 608 to the escutcheon 602 with a bushing 612. A retention plate 642 is utilized in this embodiment to secure a link arm 622, a pin 636, and a cam 634 within a recess 650. A stop 648 extends between the handle 604 and the escutcheon 602. The stop 648 may be fixed to either of the handle 604 or the escutcheon 602 with mechanical, press-fit, and/or adhesive elements. In an embodiment where the stop 648 is secured to the handle 604, the stop 648 is fixed to the handle 604 above line 670. When fixed to the handle 604, the stop 648 slides within a slot 658, such as described above with regard to FIGS. 7A and 7B. In an alternative embodiment, the stop 648 may be secured to the escutcheon 602 below the line 670. In that case, the stop 648 would slide within a handle slot 672, contacting either end thereof to prevent over-rotation.

Figure 8A:
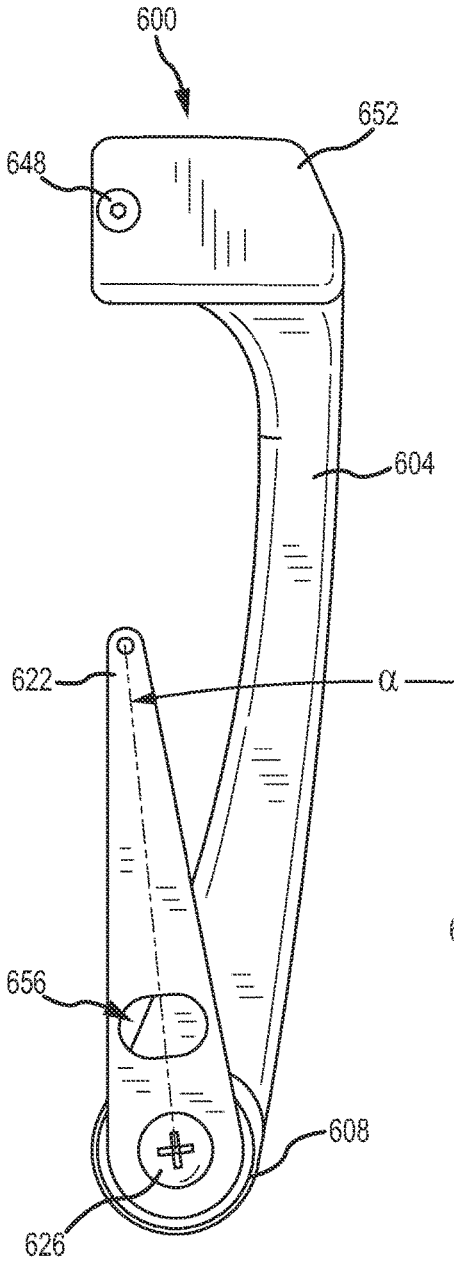
FIGS. 8A and 8B are partial rear views of the lock actuation assembly of FIGS. 7A and 7B, respectively.
Figure 8B:
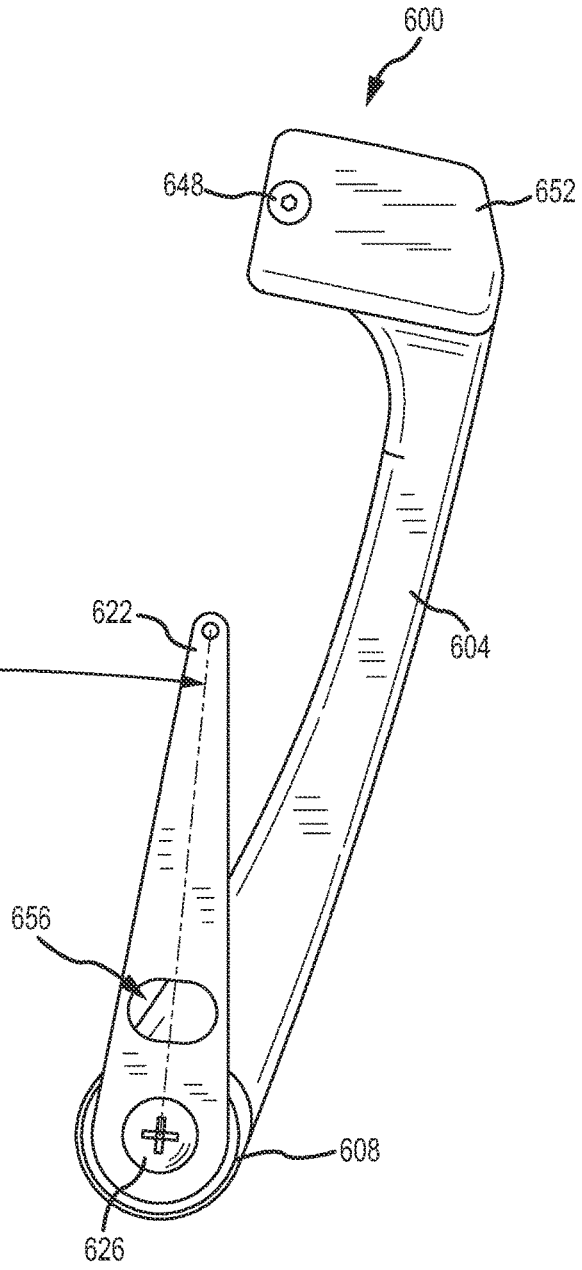

FIGS. 8A and 8B are partial rear views of the lock actuation assembly 600 of FIGS. 7A and 7B, respectively. The handle 604 rotates between a first handle position (depicted in FIG. 8A) and a second handle position (depicted in FIG. 8B) to move a pivoting locking member between an extended position and a retracted position. Since the handle 604 and link arm 622 are secured with a fastener 626, the link arm 622 rotates with the handle 604. An angle $\alpha$ between a first link arm position (depicted in FIG. 8A) and a second link arm position (depicted in FIG. 8B) may be as required or desired for a particular application. In the depicted embodiment, the angle is about 11 degrees. In alternative embodiments, the angle may be between about 7 degrees and about 15 degrees, or between about 5 degrees and about 20 degrees. Other angles of rotation are contemplated and the handle 604 may have various aesthetic designs (e.g., to match an escutcheon or to achieve compliance with certain standards, such as the American with Disabilities Act).

The materials utilized in the manufacture of the lock actuator assembly may be those typically utilized for lock and handle manufacture, e.g., zinc, steel, brass, stainless steel, etc. Material selection for most of the components may be based on the proposed use of the lock assembly, level of security desired, etc. Appropriate materials may be selected for a lock assembly used on sliding doors, or on doors that have particular security requirements, as well as on lock assemblies subject to certain environmental conditions (e.g., moisture, corrosive atmospheres, etc.). For particularly light-weight door panels or low-security panels, molded plastic, such as PVC, polyethylene, etc., may be utilized for the various components. Nylon, acetal, Teflon®, or combinations thereof may be utilized for various components (e.g., the bushing) to reduce friction, although other low-friction materials are contemplated. The handle and escutcheon may also be finished by known powder coating processes.

The terms first, second, retracted, extended, latched, unlatched, locked, unlocked, upper, lower, etc., as used herein, are relative terms used for convenience of the reader and to differentiate various elements of the lock actuation assembly from each other. In general, unless otherwise noted, the terms are not meant to define or otherwise restrict location of any particular element or the relationship between any particular elements. For example, although the embodiments depicted herein are described such that the handle/escutcheon interface is disposed at the top of the assembly, the assemblies may also be installed upside down. The lock actuator assemblies described herein may be utilized in new doors or may be retrofitted into existing installations. As can be seen from the figures, the pivoting handles described herein differ significantly from conventional non-pivoting handles located on sliding doors. In other embodiments, the link arm and cam need not be utilized and the interface axis $A_I$ and the tailpiece axis $A_T$ would be substantially collinear. In such an embodiment, the handle may be configured with a tailpiece at the first end to engage with the actuator slot. Such embodiments may be desirable in certain applications, but the depicted embodiments utilizing the link arm and cam helps maintain size and location similar to those of conventional, non-pivoting sliding door handles. Additionally, embodiments utilizing the link arm and cam offer mechanical advantages that may not be present in an embodiment where the handle connects directly to the locking mechanism.

The lock actuator assemblies depicted herein may be sold in a kit including the components necessary to construct a complete door lock using a locking mechanism and a lock actuator assembly. In certain embodiments, the kit may include a handle, an escutcheon, a link arm, and a cam, and any required connectors or fasteners. Additionally, the elements of the lock actuation assembly may be sold as a kit separate from a locking mechanism to enable easy retrofitting of the lock actuation assembly onto an existing door with an existing lock mechanism. Additionally, certain components depicted as unitary herein may be made of discrete parts that are assembled in the field. For example, a cam including an opening for receiving a discrete tailpiece may be utilized. Multiple tailpieces of different lengths may be included in the kit such that a tailpiece of the correct length may be field-selected for a door having a particular thickness (e.g., deep or shallow).

While there have been described herein what are to be considered exemplary and preferred embodiments of the present technology, other modifications of the technology will become apparent to those skilled in the art from the teachings herein. The particular methods of manufacture and geometries disclosed herein are exemplary in nature and are not to be considered limiting. It is therefore desired to be secured in the appended claims all such modifications as fall within the spirit and scope of the technology. Accordingly, what is desired to be secured by Letters Patent is the technology as defined and differentiated in the following claims, and all equivalents.

What is claimed is:

1. A lock actuation assembly comprising:

an escutcheon defining an escutcheon axis;

a handle comprising a first end pivotably connected to the escutcheon at an interface;

a link arm pivotably mounted in the escutcheon, the link arm comprising a first end, an opposite second end, a first tapered edge, and a second tapered edge;

a projection engaged with the first end of the handle and the first end of the link arm; and a cam located in the escutcheon, wherein the cam is rotatably engaged with the second end of the link arm, the cam comprising a tailpiece adapted for engagement with a locking mechanism, wherein the handle is configured to pivot the link arm between a first link arm position and a second link arm position such that the tailpiece rotates thereby actuating the locking mechanism, and wherein when the link arm is in the first link arm position, the first tapered edge is substantially parallel to the escutcheon axis and when the link arm is in the second link arm position, the second tapered edge is substantially parallel to the escutcheon axis.

2. The lock actuation assembly of claim 1, wherein the interface comprises an interface axis and the tailpiece comprises a tailpiece axis, wherein the cam pivots about the tailpiece axis, and wherein the interface axis and the tailpiece axis are parallel.

3. The lock actuation assembly of claim 1, wherein the handle is pivotable between a first handle position and a second handle position, wherein the cam is pivotable between a first cam position and a second cam position, and wherein when the handle is in the first handle position, the link arm is in the first link arm position, and the cam is in the first cam position.

4. The lock actuation assembly of claim 1, further comprising a rivet for rotatably engaging the second end of the link arm with the cam.

5. The lock actuation assembly of claim 3, wherein an angle between the first handle position and the second handle position is from about 5 degrees to about 20 degrees.

6. The lock actuation assembly of claim 5, wherein the angle is about 11 degrees.

7. The lock actuation assembly of claim 1, wherein the link arm defines an opening for receiving a mounting element, wherein the mounting element is adapted to mount the lock actuation assembly onto a stile of a door.

8. The lock actuation assembly of claim 1, wherein the projection is integral with at least one of the handle and the link arm.

9. The lock actuation assembly of claim 1, further comprising a stop for limiting a pivoting range of the handle.

10. The lock actuation assembly of claim 9, wherein the stop slidably engages a second end of the handle with the escutcheon.

11. A lock actuation assembly comprising:

an escutcheon having an escutcheon axis;

a handle comprising a first handle end pivotably connected to the escutcheon at an interface, wherein the first handle end is pivotable about an interface axis;

a cam disposed in the escutcheon and operably connected to the handle, wherein the cam comprises a tailpiece adapted for engagement with a locking mechanism, wherein the tailpiece is pivotable about a tailpiece axis that is substantially parallel to the interface axis; and a link arm comprising a first link arm end, an opposite second link arm end, a first tapered edge, and a second tapered edge, wherein the first link arm end is fixedly engaged with the handle and the second link arm end is pivotably engaged with the cam such that a rotation of the handle rotates the tailpiece thereby actuating the locking mechanism, and wherein when the link arm is in a first position, the first tapered edge is substantially parallel to the escutcheon axis, and wherein when the link arm is in a second position, the second tapered edge is substantially parallel to the escutcheon axis.

12. The lock assembly of claim 11, wherein the handle is pivotable between a rest position and a stop position.

13. The lock assembly of claim 12, further comprising a stop for preventing a pivoting of the handle past the stop position.

14. The lock assembly of claim 13, wherein the stop extends from the handle and is slidably engaged with a slot defined by the escutcheon.

15. The lock assembly of claim 14, wherein the stop extends from a second end of the handle.

16. The lock assembly of claim 11, wherein the link arm comprises a taper from the first link arm end to the second link arm end.

17. A kit useful in forming a lock actuation assembly, the kit comprising:

an escutcheon adapted to be secured to a stile of a door, wherein the escutcheon has an escutcheon axis;

a handle comprising a first end, wherein the first end is adapted to be pivotably connected to the escutcheon at an interface;

a link arm adapted to be pivotably received in the escutcheon, the link arm comprising a first end, an opposite second end, a first tapered edge, and a second tapered edge;

a projection adapted to engage the first end of the handle with the first end of the link arm; and a cam adapted to be pivotably received in the escutcheon, wherein the cam is adapted to be rotatably engaged with the second end of the link arm, the cam comprising a tailpiece adapted for engagement with a locking mechanism, wherein the handle is configured to move the link arm between a first position and a second position such that the locking mechanism is actuated via the tailpiece, and wherein when the link arm is in the first position, the first tapered edge is substantially parallel to the escutcheon axis and when the link arm is in the second position, the second tapered edge is substantially parallel to the escutcheon axis.

18. The kit of claim 17, further comprising a stop adapted to be fixed to at least one of the handle and the escutcheon.

* * * * *